US008810422B2

(12) United States Patent
Musete et al.

(10) Patent No.: US 8,810,422 B2
(45) Date of Patent: Aug. 19, 2014

(54) SURVEILLANCE SYSTEM

(75) Inventors: Romeo Musete, New Westminster (CA); Robert Lee, Garden City, NY (US)

(73) Assignee: Honeywell International, Inc., Morristown, NJ (US)

( * ) Notice: Subject to any disclaimer, the term of this patent is extended or adjusted under 35 U.S.C. 154(b) by 745 days.

(21) Appl. No.: 11/961,069

(22) Filed: Dec. 20, 2007

(65) Prior Publication Data

US 2009/0160667 A1 Jun. 25, 2009

(51) Int. Cl.

| | |
|---|---|
| ***G08B 21/00*** | (2006.01) |
| ***G08B 13/14*** | (2006.01) |
| ***G08B 29/04*** | (2006.01) |
| ***G08B 13/196*** | (2006.01) |

(52) U.S. Cl.

CPC ..... *G08B 13/1436* (2013.01); *G08B 29/046* (2013.01); *G08B 13/19697* (2013.01)

USPC ..... 340/669; 340/521

(58) Field of Classification Search

USPC ..... 340/669, 521, 539.22

See application file for complete search history.

(56) References Cited

U.S. PATENT DOCUMENTS

| | | | | |
|---|---|---|---|---|
| 5,612,670 | A * | 3/1997 | Snyder et al. | 340/429 |
| 7,250,853 | B2 | 7/2007 | Flynn | |
| 2005/0275527 | A1 * | 12/2005 | Kates | 340/539.22 |
| 2006/0139162 | A1 * | 6/2006 | Flynn | 340/521 |
| 2006/0220850 | A1 * | 10/2006 | Bowser et al. | 340/568.1 |
| 2007/0085676 | A1 | 4/2007 | Lee et al. | |
| 2007/0266799 | A1 | 11/2007 | Sugiura | |

FOREIGN PATENT DOCUMENTS

| | | | |
|---|---|---|---|
| EP | 1174839 | A2 * | 1/2002 |

* cited by examiner

*Primary Examiner* — Shirley Lu
(74) *Attorney, Agent, or Firm* — Husch Blackwell LLP

(57) ABSTRACT

This invention relates generally to the field of surveillance systems, and in particular to fault and alarm condition reporting to a monitoring system. The surveillance system comprises a plurality of identification sensors and a measurement device coupled to each of the plurality of identification sensors for measuring the acceleration thereof. A detection system connected with each of the plurality of identification sensors processes acceleration data measured from each of the measurement devices. Based on the processing of the acceleration data, an alert is generated by an alert system.

20 Claims, 2 Drawing Sheets

SURVEILLANCE SYSTEM

FIELD OF THE INVENTION

This invention relates generally to the field of surveillance systems, and in particular to fault and alarm condition reporting to a monitoring system.

BACKGROUND OF THE INVENTION

Video surveillance systems conventionally use video cameras to monitor and secure an area. There are several options available for a person attempting to tamper with and/or disable a surveillance camera system. The person may try to obstruct the camera's field of view by covering the camera lens with spray paint, for example. Also, the wires may be cut, or the camera may be damaged or knocked from its mount by physical force. With the last option, it's possible for the camera to still function, albeit with an altered view that may no longer display the area of interest. If the camera is monitored, the personnel monitoring the surveillance system may notice that the camera has a different field of view. However, the larger the area under surveillance, the more cameras and personnel are needed to operate the system effectively and guard against tampering. A given operator can only be effective in viewing video feeds from a small number of video cameras to identify if the camera has been tampered with.

Therefore, what is needed in the art is a method and system to generate and transmit an alert to a monitoring system if an acceleration associated with a mechanical shock to the camera is detected. The system triggers a warning signal that is sent to the monitoring system to allow law enforcement/security personnel to quickly respond.

BRIEF SUMMARY OF THE INVENTION

The present invention is directed to a surveillance system comprising a plurality of identification sensors and a measurement device coupled to each of the plurality of identification sensors. The measurement device measures acceleration of each of the plurality of identification sensors, wherein the measurement device comprises at least one of a micro-electro-mechanical system (MEMS) accelerometer and a piezoelectric sensor.

A detection system connected with each of the plurality of identification sensors processes acceleration data measured from each of the measurement devices. An alert system is also provided for generating an alert based on the processing of the acceleration data. The alert is received at a monitoring system, including a graphical user interface (GUI) that is adapted to communicate the alert. The alert comprises at least one of a visual alert and an audio alert.

The identification sensors comprise at least one of video cameras, thermal imaging cameras, night vision cameras, and parabolic listening devices. The detection system communicates with the monitoring station via a communication network. The communication network comprises a hard wired communication network and/or a wireless communication network. The communication network comprises at least one of a serial communication network, an analog communication network and a transmission control protocol/internet protocol (TCP/IP) network.

The alert is generated when an output from the acceleration data exceeds a threshold value. The threshold value is independently adjustable for each of the plurality of identification sensors and is also adjustable by the GUI.

Furthermore, the present invention is directed to a method for identifying tampering to a surveillance system, the method comprising providing a plurality of identification sensors and coupling a measurement device to each of the plurality of identification sensors. The measurement device measures acceleration of each of the plurality of identification sensors. Acceleration data measured from each of the measurement devices is processed by a detection system. Based on the processing of the acceleration data, an alert is generated by an alert system. The alert is generated when an output of the acceleration exceeds a threshold value.

The present invention further comprises receiving the alert on a monitoring system, wherein the monitoring system includes a graphical user interface that is adapted to communicate the alert. Generating the alert comprises producing at least one of a visual alert and an audio alert.

DETAILED DESCRIPTION OF THE INVENTION

Figure 1:
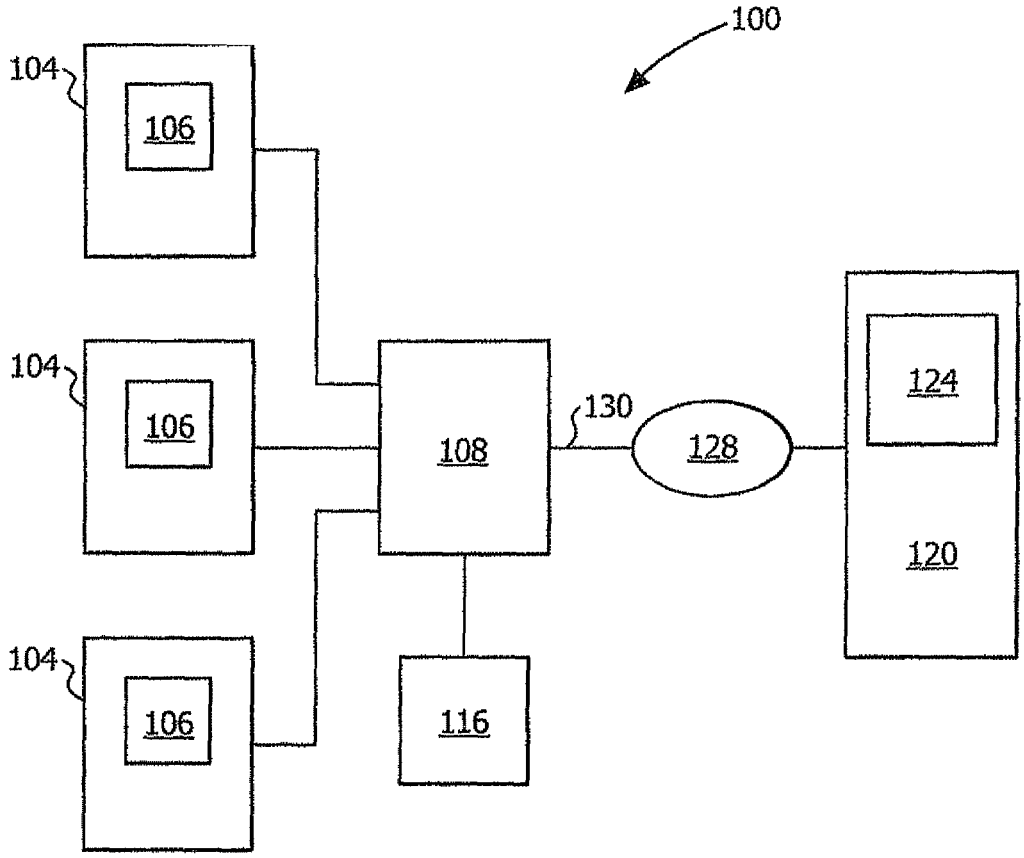
FIG. 1 illustrates a surveillance system according to an aspect of the present invention.

The present invention, which provides a surveillance system including a measurement device coupled to a plurality of identification sensors to identify acceleration thereof as well as methods of doing the same, will now be described in greater detail by referring to the drawings that accompany the present application. It is noted that the drawings of the present application are provided for illustrative purposes and are thus not drawn to scale.

Aspects of the invention will be described with reference to FIG. 1, which depicts a surveillance system 100 according to the present invention. The surveillance system 100 includes a plurality of identification sensors 104 and a measurement device 106 coupled to each of the plurality of identification sensors 104. The measurement device 106 measures acceleration of each of the plurality of identification sensors 104. A detection system 108 connected with each of the plurality of identification sensors 104 processes acceleration data measured from each of the measurement devices 106. Based on the processing of the acceleration data, an alert is generated by an alert system 116.

The plurality of identification sensors 104 provides classification and identification functions for the surveillance system 100. The exact number of identification sensors 104 depends on the particular application and the area to be covered. In a preferred embodiment of the invention, the surveillance system 100 is a video surveillance system and each of the plurality of identification sensors 104 is a video camera. However, it can be appreciated that the identification sensors 104 may include thermal imaging cameras, night vision cameras, parabolic listening devices or other similar devices.

As shown in FIG. 1, each of the plurality of identification sensors 104 comprises a measurement device 106 for measuring acceleration of each of the plurality of identification sensors 104. In one embodiment, the measurement device 106 comprises at least one of a micro-electro-mechanical system (MEMS) accelerometer and a piezoelectric sensor. As is well known, conventional MEMS accelerometers employ an inertial mass suspended from a frame by multiple support beams (not shown). The inertial mass, support beams, and frame generally act as a spring mass system, such that the displacement of the inertial mass is proportional to the linear acceleration applied to the frame. The displacement of the mass generates a voltage proportional to linear acceleration, which is used as a measure of the linear acceleration.

Many MEMS accelerometers are capacitive type sensing devices that employ a capacitive coupling between fixed and movable capacitive plates, in which the movable plates move in response to linear acceleration along a sensing axis. The MEMS accelerometer may also be a dual-axis accelerometer capable of sensing complex linear acceleration along two orthogonal sensing axes.

Piezoelectric sensors are typically comprised of a piezoelectric body sandwiched between two electrodes. The piezoelectric sensor generates an electric charge by means of piezoelectric effect caused by a deformation on the piezoelectric body, so as to output an electric voltage signal between the electrodes. Deformation of the piezoelectric sensor may be the result of mechanical forces (i.e., accelerations, vibrations or physical contact) exerted on the identification sensor 104. Furthermore, because the signal generated by the piezoelectric effect may be weak, the signal may optionally be sent to an amplifier (not shown) for amplification.

The measurement device 106, including piezoelectric sensors and/or MEMS accelerometers, communicates with the detection system 108. The detection system 108 processes the acceleration data measured by the measurement device 106 and determines an output based on the amplitude and frequency (cycle) of the electrical signal. The determination based on the cycle includes a determination that, when the amplitude (output) from the acceleration data exceeds a threshold value for a given time period, an alert is generated by the alert system 116.

The alert is transmitted to a monitoring system 120 that is configured to communicate with the plurality of identification sensors 104 and the detection system 108, including, for example, receiving alarm signals, alert signals or other types of security condition signals at the monitoring system 120. In this embodiment, the detection system 108 is shown as a separate external component connected to each of the plurality of identification sensors 104. However, it can be appreciated that the detection system 108 may be located within each of the plurality of identification sensors 104 in an alternative embodiment.

The plurality of identification sensors 104 and the detection system 108 are connected to the monitoring system 120 via a server 128 and a communication network 130. In one embodiment, the communication network 130 comprises a serial communication network, such as known standards RS232 and RS422 which define the communication between data terminal equipment and data communication equipment (not shown). In another embodiment, the communication network 130 comprises an analog transmission network that uses a continuous signal that varies in amplitude, phase, or some other property in proportion to that of a variable. Furthermore, the communication network 130 may also comprise a standard transmission control protocol/internet protocol (TCP/IP) network. It can be appreciated that a number of communication networks are possible within the scope of the invention.

The detection system 108 may communicate remotely with the monitoring system 120 via server 128 and a wireless communication network 130. However, the present invention is not limited to wireless networks. The surveillance system 100 may use a hard wired communication network, e.g., coaxial cable, twisted pair, copper cable, fiber optic cable or other appropriate media for carrying data between the plurality of identification sensors 104, the detection system 108 and the monitoring system 120.

The monitoring system 120 may provide an input for an operator to configure some of the settings of the surveillance system 100. For example, in one embodiment, monitoring system 120 enables the operator to define the boundaries of the zone monitored by the surveillance system 100. Furthermore, the monitoring system 120 includes a graphical user interface (GUI) 124 adapted to communicate the alert generated by the alert system 116. The alert comprises at least one of a visual alert and an audio alert, although a variety of alerts are possible within the scope of the invention. GUI 124 may comprise any interface that allows a user or security personnel to enter commands and otherwise interact with each of the plurality of identification sensors 104. For example, in one embodiment, the GUI allows the operator to independently adjust the threshold value for each of the plurality of identification sensors.

Furthermore, the GUI 124 enables the operator to adjust the area under surveillance and to establish criteria for identifying a threat. In the case that multiple identification sensors 104 are tampered with, the monitoring system 120 allows the operator to establish prioritization criteria for determining how to handle the presence of simultaneous threats. In this case, the monitoring system 120 may provide the operator with a list of criteria to use in establishing a prioritization scheme.

The monitoring system 120 may include memory (not shown) for storing the post-processing video signal and alert condition(s). Memory may comprise any known type of data storage and/or transmission media, including magnetic media, optical media, random access memory (RAM), read-only memory (ROM), a data cache, a data object, or other similar devices. Moreover, memory may reside at a single physical location, comprising one or more types of data storage, or be distributed across a plurality of physical systems in various forms.

Figure 2:
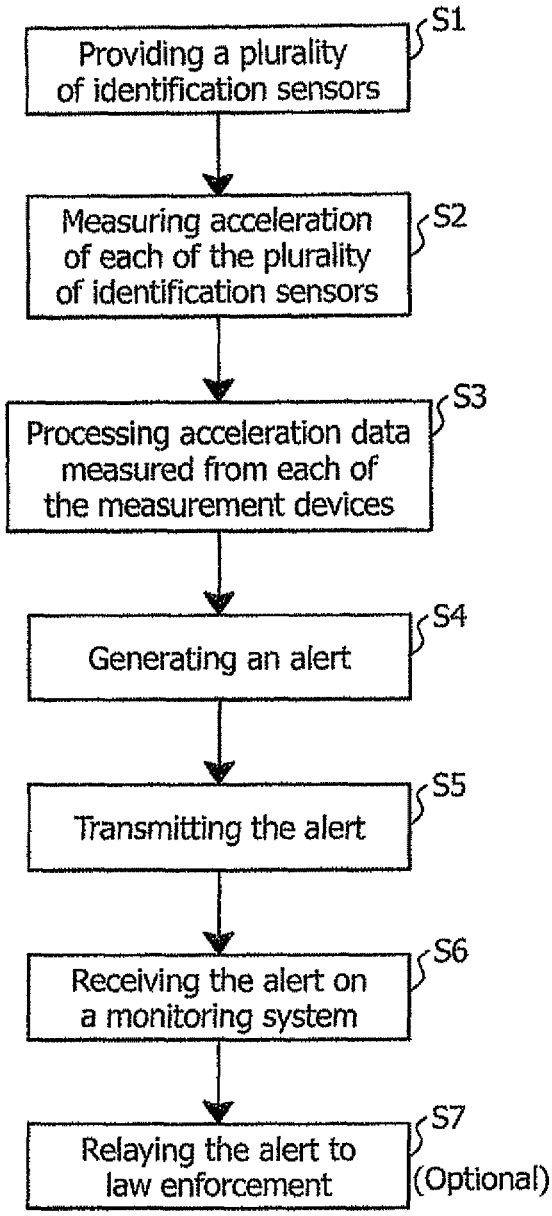
FIG. 2 illustrates a flowchart of an operation of a system according to an aspect of the present invention.

An operation of the surveillance system 100 according to the present invention will now be provided with reference to FIGS. 1-2. As shown in FIG. 1, the surveillance system 100 provides a plurality of identification sensors 104 for monitoring an area of interest (S1). At S2, acceleration of each of the plurality of identification sensors 104 is measured by a measurement device 106 coupled to each of the plurality of identification sensors 104. At S3, acceleration data measured from each of the measurement devices 106 is processed by the detection system 108 connected with each of the plurality of identification sensors 104. The detection system 108 communicates with each measurement device 106 to receive acceleration data for each of the plurality of identification sensors 104. If a relatively large acceleration is measured by the measurement device 106, a possible alert condition is present. For example, an alert condition may be present if an identification sensor 104 has been struck by physical force, inadvertently or otherwise.

To evaluate whether an alert should be generated, during the processing step at S3, an output of the acceleration measured by the measurement device 106 is compared to a threshold value. In one embodiment, the threshold value corresponds to a preset voltage point. If the voltage (output) from the acceleration data identified by the measurement device 106 exceeds the preset voltage point, an alert condition is present. The "sensitivity" of the measurement device 106 and the detection system 108 can be adjusted by raising or lowering the threshold value. For example, if an identification sensor 104 is located in an area prone to environmental vibration, the preset voltage point can be raised to decrease the likelihood of a false alarm for that identification sensor 104.

In another embodiment, during the processing step at S3, an algorithm can be used that identifies energy that is associated with a relatively high frequency and that rises above a certain point. This energy is then integrated over a finite time and the result is compared to the threshold value to determine if an alert condition exists. In some embodiments, the logic functions processing the output include time measurement, parameterization, and/or Root Mean Square (RMS) detection.

Once the threshold value has been exceeded, an alert is generated at S4 by the alert system 116. At S5, the alert system 116 transmits the alert as an electrical signal to the monitoring system 120 via the communication network 130.

The detection system 108 and the alert system 116 are in communication with the monitoring system 120. At S6, the monitoring system 120 receives the alert and communicates it to security personnel via the GUI 124. The alert comprises any number of audio/visual alerts to adequately communicate the alert and to identify the specific identification sensor(s) 104 associated with the threat.

At S7, the alarm may be optionally relayed to an appropriate law enforcement agency. This may be desirable if the monitoring system is unmonitored or unoccupied, or if additional support is necessary.

Accordingly, a more efficient, faster and more cost-effective alert condition notification may be provided for the case in which an identification sensor is tampered with by an external mechanical force. Furthermore, the surveillance system is more automated, as the alert generation and transmission does not necessarily involve a central station or human operators.

While the present invention has been described in an illustrative manner, it should be understood that the terminology used is intended to be in a nature of words of description rather than of limitation. Furthermore, while the present invention has been described in terms of illustrative and alternate embodiments, it is to be appreciated that those skilled in the art will readily apply these teachings to other possible variations of the invention.

We claim:

1. A surveillance system, comprising:

a monitoring system, the monitoring system further comprises:

a plurality of identification sensors that are each located in and monitor an area of interest of the surveillance system; and a graphical user interface that receives data from each of the plurality of identification sensors and through which a user interacts with each of the plurality of identification sensors; and a detection system that couples tampering alerts to the monitoring system via a communication network, the detection system further comprises:

a respective measurement device coupled to a surface of each of the plurality of identification sensors and that measures acceleration associated with mechanical shock caused by tampering, wherein the detection system is connected with the respective measurement device on each of the plurality of identification sensors, communicates with the measurement device and processes acceleration data measured by the measurement device;

an alert system of the detection system that generates an alert based on the processing of the acceleration data from at least one of the plurality of measurement devices and transmits the generated alert to the monitoring system via the communication network, wherein the monitoring system receives the generated alert and communicates the generated alert to the user via the graphical user interface, the generated alert communicated to the user including an identifier of the at least one of the plurality of measurement devices associated with the tampering.

2. The system of claim 1, wherein the detection system compares an output of the acceleration data to a threshold value.

3. The system of claim 2, wherein the alert is generated when the output of the acceleration data exceeds the threshold value.

4. The system of claim 2, wherein the threshold value is independently adjustable for each of the plurality of identification sensors.

5. The system of claim 2, further comprising a monitoring system to receive the alert.

6. The system of claim 5, wherein the monitoring system comprises a graphical user interface that is adapted to communicate the alert.

7. The system of claim 6, wherein the threshold value is adjustable by the GUI.

8. The system of claim 5, wherein the detection system communicates with the monitoring station over a communication network.

9. The system of claim 8, wherein the communication network comprises at least one of a serial communication network, an analog communication network and a transmission control protocol/internet protocol (TCP/IP) network.

10. The system of claim 8, wherein the communication network comprises a hard wired communication network.

11. The system of claim 8, wherein the communication network comprises a wireless communication network.

12. The system of claim 1, wherein the plurality of identification sensors comprise at least one of video cameras, thermal imaging cameras, night vision cameras, and parabolic listening devices.

13. The system of claim 1, wherein the alert comprises at least one of a visual alert and an audio alert.

14. The system of claim 1, wherein the measurement device comprises at least one of a micro-electro-mechanical system (MEMS) accelerometer and a piezoelectric sensor.

15. A method for identifying tampering to a surveillance system, the method comprising:

providing a plurality of identification sensors that are each located in and that monitor an area of interest of the surveillance system;

measuring acceleration associated with a mechanical shock by tampering by coupling a measurement device to a surface of each of the plurality of identification sensors;

processing acceleration data measured from each of the measurement devices by a detection system;

generating an alert based on the processing of the acceleration data from at least one of the plurality of identification sensors;

a monitoring system receiving data carried from the plurality of identification sensors and the alert system;

a user interacting with each of the plurality of identification sensors through a graphical user interface of the monitoring system; and the graphical user interface communicating the generated alert to the user including an identifier of the at least one identification sensors associated with the tampering.

16. The method of claim 15, wherein the processing comprises comparing an output of the acceleration data to a threshold value.

17. The method of claim 16, wherein the alert is generated when the output value of the acceleration data exceeds the threshold value.

18. The method of claim 16, further comprising receiving the alert on a monitoring system.

19. The method of claim 18, wherein the monitoring system includes a graphical user interface that is adapted to communicate the alert.

20. The method of claim 15, wherein generating the alert comprises producing at least one of a visual alert and an audio alert.

* * * * *